United States Patent [19]

Beghi et al.

[11] 4,191,300

[45] Mar. 4, 1980

[54] HOISTING DEVICE FOR HIGH-POWER CRANE

[76] Inventors: René Beghi, 13 Rue General Pershing, 78000 Versailles; Gabriel Desmars, 3 Rue de Cousson, 44000 Nantes; Yvan Monié, Chemin Rural 167, Pince Vins,92500 Rueil; Raymond Pessayre, 105 Avenue de La Bourdonnais, 75007 Paris, all of France

[21] Appl. No.: 877,386

[22] Filed: Feb. 13, 1978

Related U.S. Application Data

[63] Continuation of Ser. No. 658,076, Feb. 13, 1976, abandoned.

[30] Foreign Application Priority Data

Feb. 18, 1975 [FR] France ..... 75/04982

[51] Int. Cl.[2] ..... B66C 1/14

[52] U.S. Cl. ..... 212/41; 254/106; 294/78 A

[58] Field of Search ..... 212/9, 11, 14, 40, 41, 212/45, 97, 125, 135; 254/106; 294/78 R, 81 R, 67 R, 78 A, 81 SF

[56] References Cited

U.S. PATENT DOCUMENTS

| | | | |
|---|---|---|---|
| 1,114,832 | 10/1914 | Whitney | 254/106 |
| 1,351,226 | 8/1920 | Barlow | 212/44 |
| 2,010,054 | 8/1935 | Brotz et al. | 294/81 R |
| 3,096,075 | 7/1963 | Brown | 254/106 X |
| 3,485,478 | 12/1969 | Desplats | 254/106 |
| 3,889,926 | 6/1975 | Ahlgren | 254/106 |

FOREIGN PATENT DOCUMENTS

| | | | |
|---|---|---|---|
| 2414559 | 10/1974 | Fed. Rep. of Germany | 212/11 |
| 2335407 | 1/1975 | Fed. Rep. of Germany | 212/9 |
| 1059932 | 2/1967 | United Kingdom | 254/106 |

*Primary Examiner*—Robert G. Sheridan

[57] ABSTRACT

This hoisting device is intended for orienting and balancing in space the load suspended from the jib of a high-power crane and comprises for each oblique suspension rope attached to the load a traction assembly comprising in turn two pairs of cylinders each associated with one traction block and operating by turns and step-by-step in order to provide a substantially constant traction rate independent of that of the other groups. Conduit means connect said cylinders to the control means housed in the crane control cab and are provided with interconnecting means for balancing the forces in each rope as desired by the operator.

6 Claims, 24 Drawing Figures

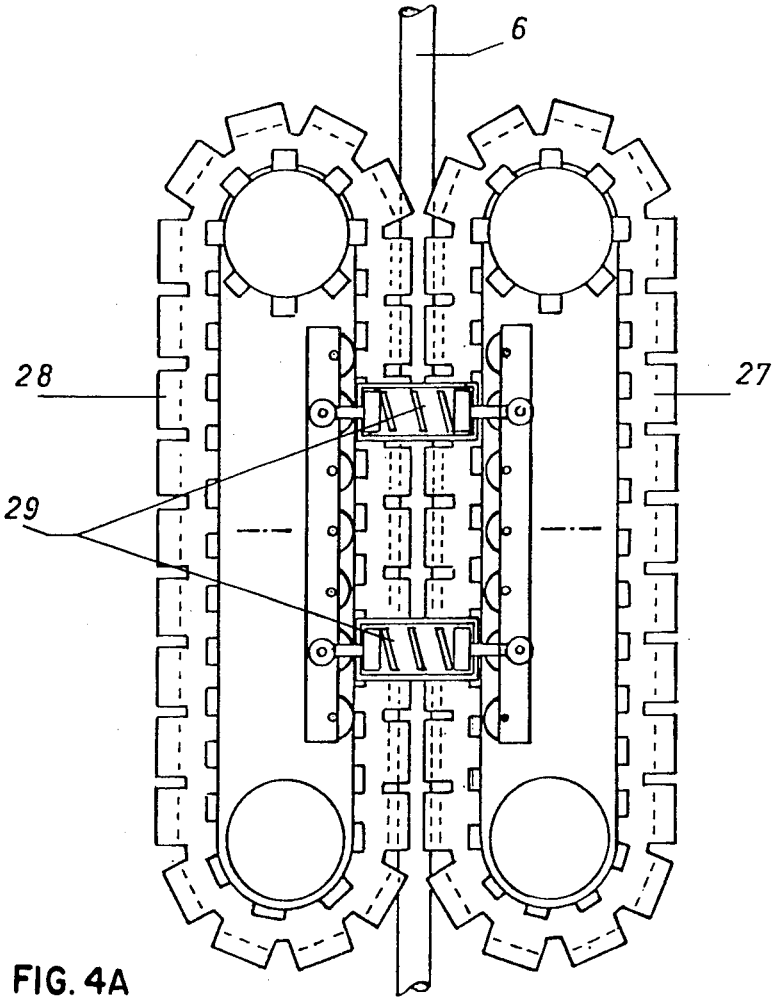
FIG. 4A
FIG. 4B
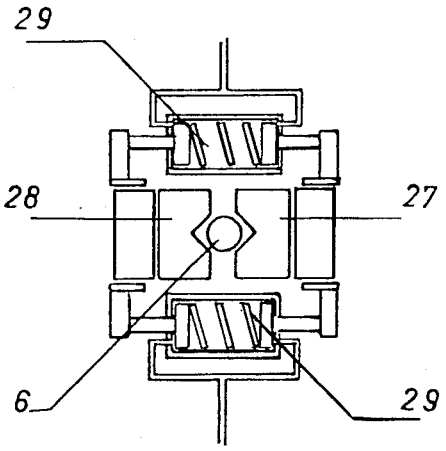

HOISTING DEVICE FOR HIGH-POWER CRANE

This is a continuation of application Ser. No. 658,076, filed Feb. 13, 1976, now abandoned.

BACKGROUND OF THE INVENTION

Field of the Invention

The present invention relates in general to cranes and has specific reference to a hoisting device capable of positioning in the space a load by means of a high-power crane, for example a crane having a load capacity of over 300 tons.

It is known that positioning a heavy load suspended by means of several ropes from the jib of a crane constitutes a difficult problem, since the length of each rope is invariable and the load, when hoisted, has not compulsorily the desired orientation.

To avoid this difficulty, cranes comprising two or more suspension hooks have been proposed in the past, but they require for their operation ropes having an abnormally great diameter which cannot be handled manually and therefore make it necessary to use auxiliary cranes. Moreover, these huge cranes are equipped with extremely heavy tackles, which is also a serious inconvenience.

DESCRIPTION OF THE INVENTION

The device according to this invention is based on the principle of equipping each oblique load suspension rope with a traction assembly for compensating the tractive efforts exerted on each rope and also adjusting the length of these ropes.

The traction assembly associated with each rope comprises two synchronized coupled traction groups adapted to be controlled by turns.

Each group comprises a pair of hydraulic cylinders operatively interconnected by a traction block. Each one of the two groups associated with each rope is controlled alternatively so as to cause the rope to be pulled step by step by one group, while the traction block of the other group is released. Thus, by simply controlling the cylinders of each group, it is possible to move each rope step by step and continuously.

The control means may be operatively interconnected so that each assembly can be actuated separately, or a plurality of such assemblies can be synchronized.

With this device, each unitary hoisting rope can be fastened very rapidly to the load without resorting to high-power, large-diameter ropes and the auxiliary cranes necessary for handling these large-diameter ropes. Furthermore, with this device it is possible to use the unitary hoisting ropes either separately or in combination, with or without the relative hydraulic coupling thereof, to hoist the load while distributing the weight thereof among a preselected number of ropes, to impart the desired orientation to the load in the space surrounding its center of gravity while preserving the proper stress balance between the various ropes, to position the load with precision in space, to preserve this position and finally eliminate any asymmetrical efforts in the crane jib.

This device further comprises an assembly of two parallel endless tracks urged against each rope by cylinders and permitting a fast handling at a speed of the order of 20 to 50 m/mm, when the traction assemblies are disconnected or inoperative, of course.

BRIEF DESCRIPTION OF THE DRAWINGS

FIG. 4A is an elevation view showing on an enlarged scale a portion of a hoisting assembly in inoperative state for causing fast translation of a rope;

FIG. 4B is a plan view of the portion of the hoisting assembly shown in FIG. 4A;

FIGS. 7A to 11A are diagrammatic views similar to FIG. 6 showing the function of the various possible combinations of traction assemblies shown in FIGS. 7 to 11, respectively.

DESCRIPTION OF THE PREFERRED EMBODIMENT

Figure 1:
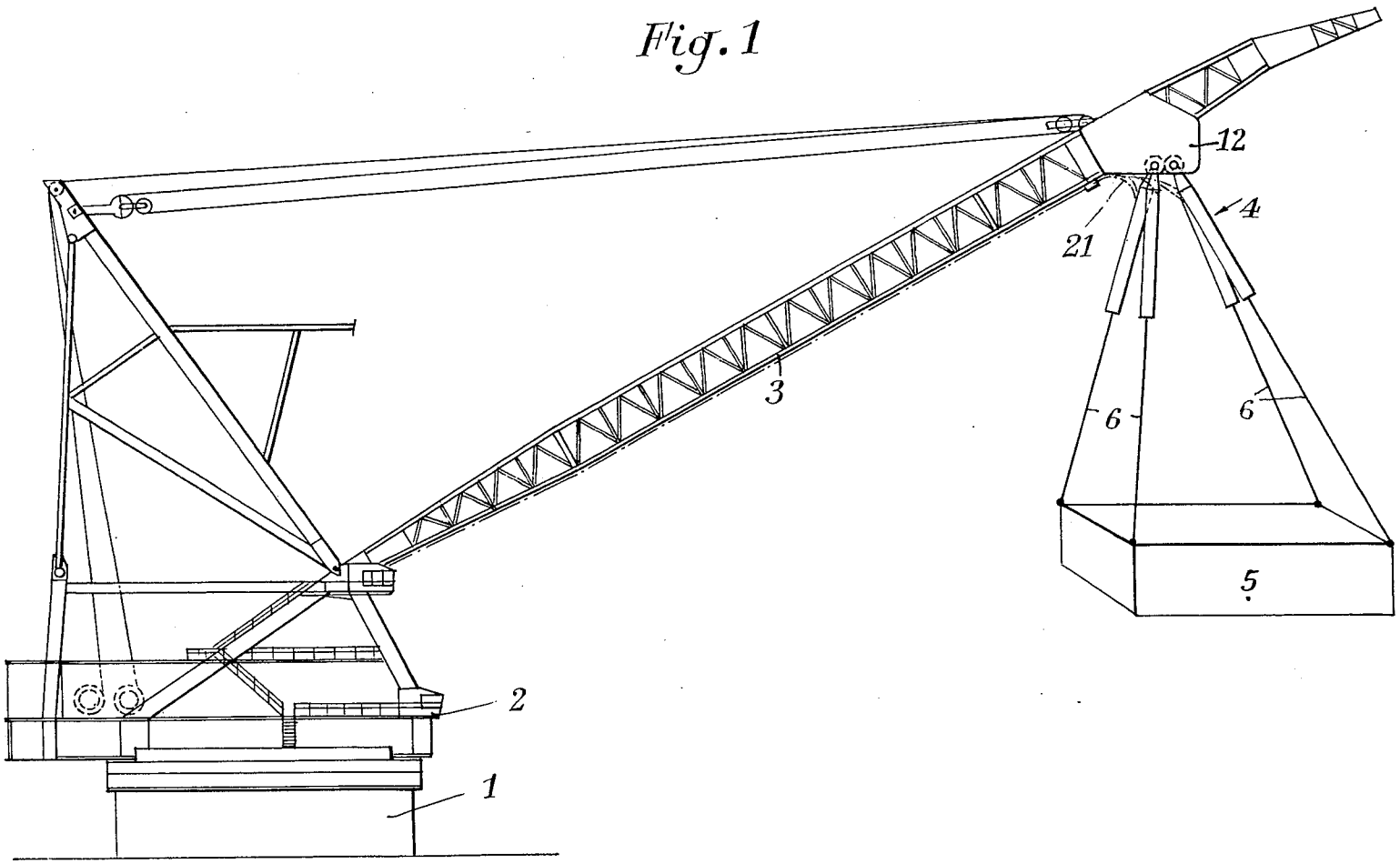
FIG. 1 is a diagrammatic side elevational view of the crane with its jib and a load suspended from a four-rope system.

The jib crane of a power rating of 300 tons or more to which the device of this invention is applied comprises as conventional a supporting base 1 to which the frame structure 2 is fastened. This frame structure 2 comprises the control cabs or rooms for the jib 3 and the hoisting system 4 from which the load 5 is suspended by means of four hoisting ropes or cables 6.

The essential feature characterizing this invention is that a traction assembly is associated with each hoisting rope 6, the four assemblies being adapted to be controlled separately or in synchronism with one another from the corresponding crane control cab so that the operator can vary at will, in each rope, the traction effort resulting from the load weight and the useful length of each rope with a view to properly position and balance the load 5.

Figure 2:
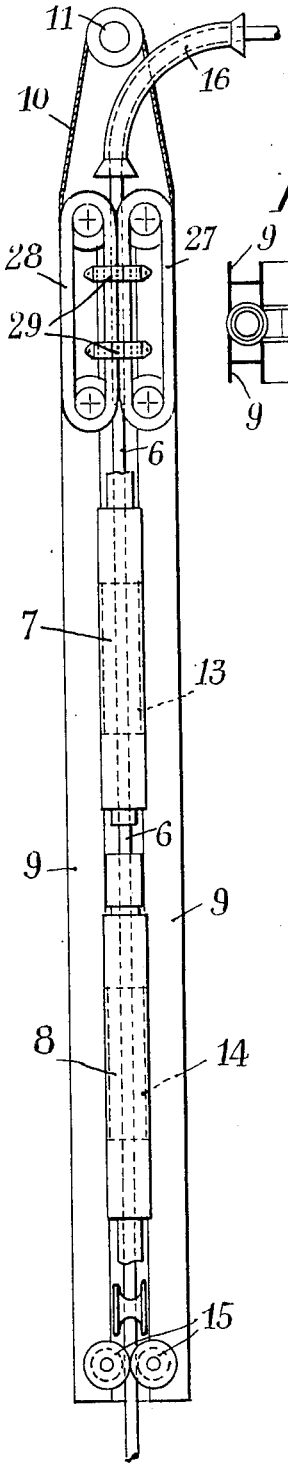
FIG. 2 is a side elevational view showing on a larger scale a hoisting assembly associated with one rope.

To this end, each traction assembly (FIG. 2) comprises two groups consisting each of a pair of hydraulic cylinders or cylinder-and-piston actuators 7, 8 of which the cylinder bodies are movable and the pistons fastened to a tubular frame comprising for example four suitably braced I-section members 9 suspended at their upper ends by means of a swivel cone 10 mounted through a pivot member 11 carried by a fish-plate assembly 12 of the jib 3.

Each pair of cylinders 7 or 8 of a given assembly comprises a traction block 13 or 14 clamped or wedged against one of the ropes 6 guided at the bottom by pulleys 15 and at the top by a tubular curved guide member 16 directed towards the jib 3.

These cylinders are controlled through hydraulic conduits and control-levers in order to exert in the known manner a continuous and step-by-step tractive effort on the rope, the cylinders 7 or 8 becoming operative when the block 13 or 14 is released, and vice versa.

Figure 4:
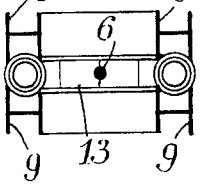
FIG. 4 is a horizontal section taken along the lines IV—IV of FIG. 3.
Figure 3:
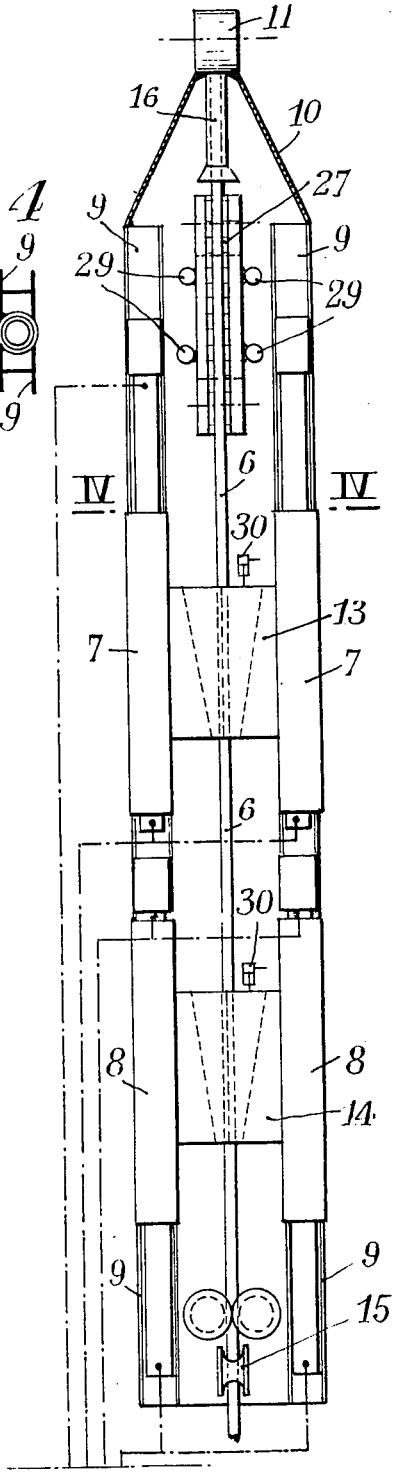
FIG. 3 is an elevational view taken after turning the assembly of FIG. 1 through 90 degrees about its vertical axis.
Figure 4C:
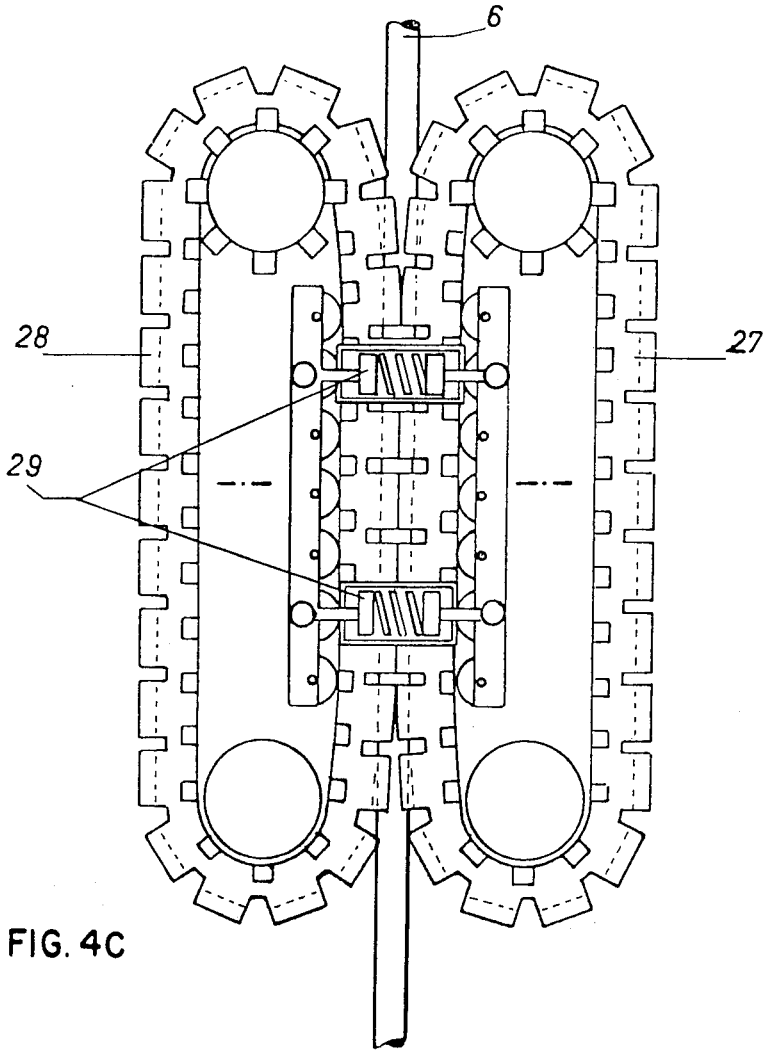
FIG. 4C shows the portion of the hoisting assembly illustrated in FIG. 4A in operative state.
Figure 4D:
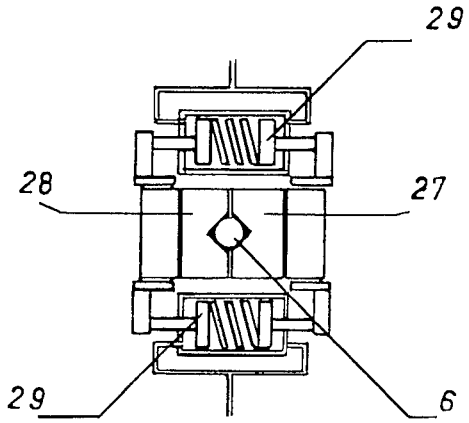
FIG. 4D is a plan view of the portion of the hoisting assembly shown in FIG. 4C.
Figure 4E:
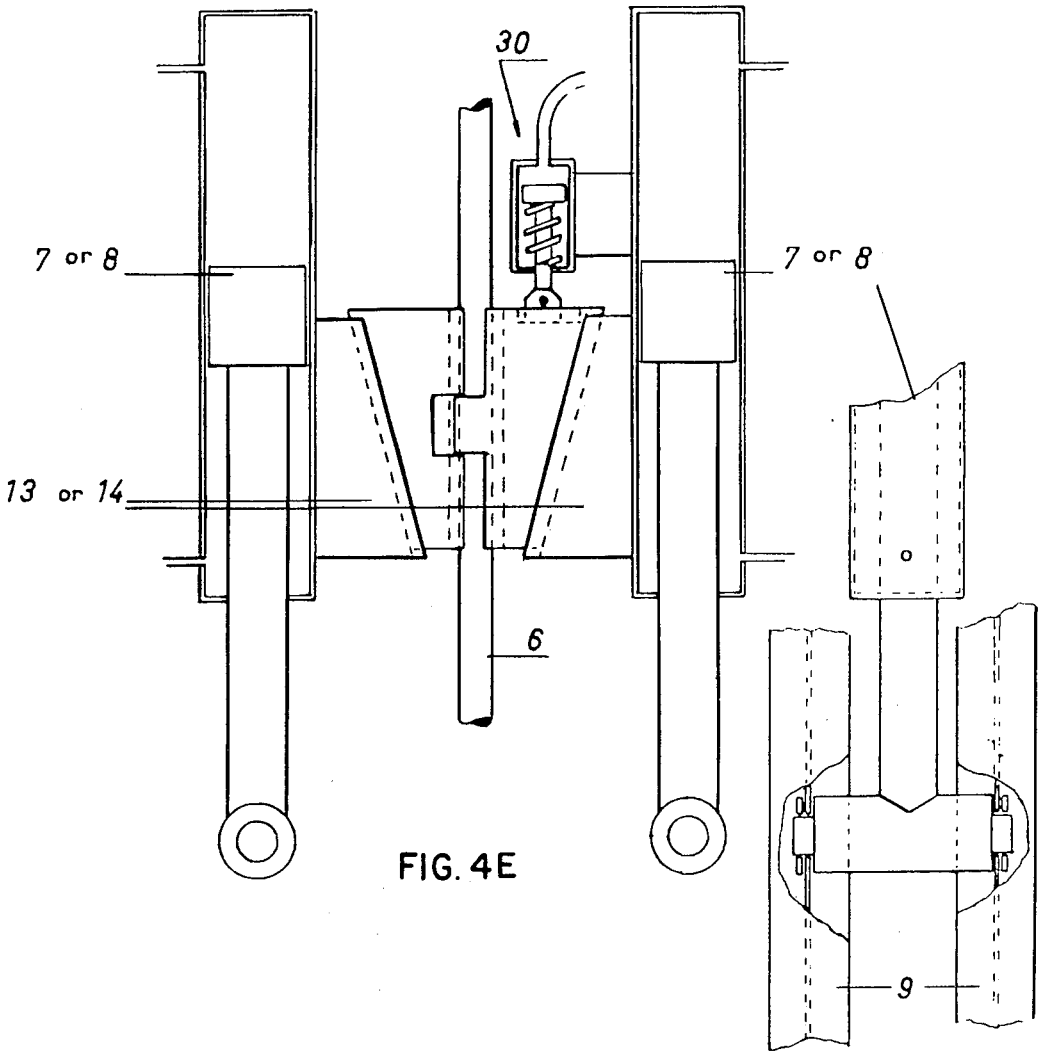
FIG. 4E is an elevation view showing on an enlarged scale another portion of a hoisting assembly in inoperative state for causing continuous and step-by-step traction effort and motion on a rope.
Figure 4F:
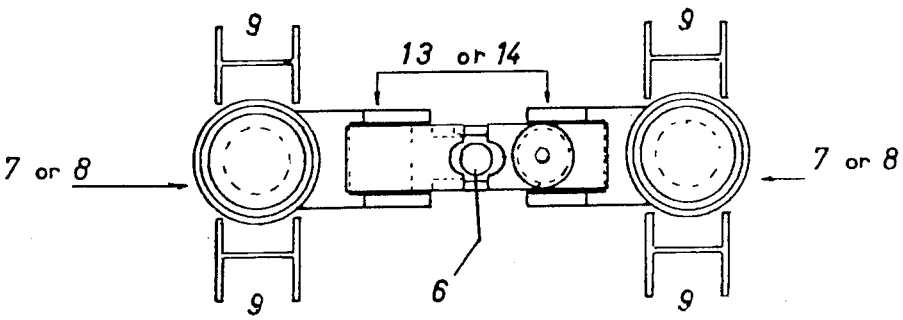
FIG. 4F is a plan view of the portion of the hoisting assembly shown in FIG. 4E.
Figure 4G:
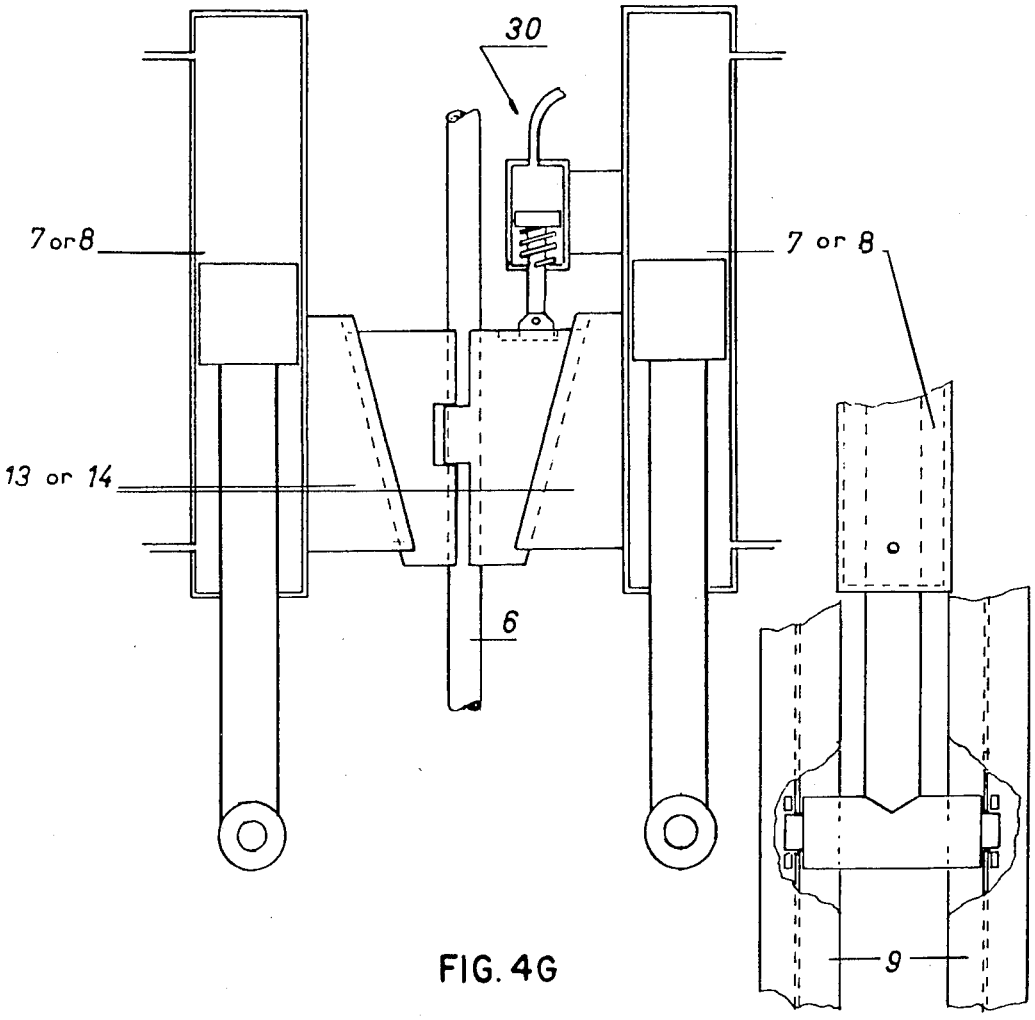
FIG. 4G shows the portion of the hoisting assembly illustrated in FIG. 4E in operative state.
Figure 4H:
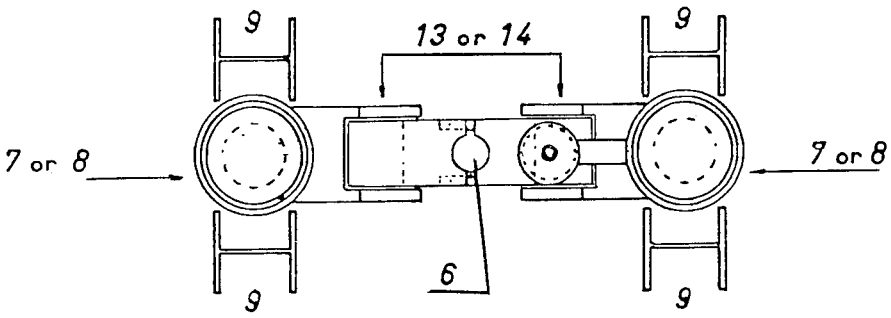
FIG. 4H is a plan view of the portion of the hoisting assembly shown in FIG. 4G.

FIGS. 4E to 4H show on an enlarged scale the structure and operation of the traction blocks 13, 14 for causing continuous and step-by-step traction effort and motion on a rope 6. Referring to FIG. 4E, the means for controlling the traction blocks are shown as cylinders 30, which in this Figure are illustrated as being in the inoperative state so that the wedging block 13 or 14 would be released and, therefore, the rope cannot be driven by the cylinder 7 or 8 associated therewith. In FIG. 4G, however, the cylinder 30 is shown as being actuated which causes the wedging block 13 or 14 to clamp rope 6 so that it can be driven by means of the cylinders 7 or 8 associated therewith, the latter having their piston rods rigid with the frame structure.

Figure 5:
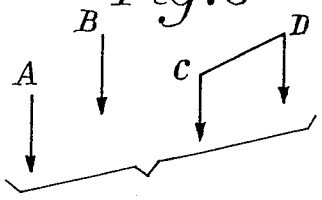
FIG. 5 is a diagram illustrating the coupling of four assemblies on four ropes.

This mode of operation is illustrated diagrammatically notably in FIG. 5 by way of example. This Figure shows a set of four traction assemblies A, B, C and D each associated with four ropes 6; assemblies A and B are independent and assemblies C and D are coupled synchronously with each other.

For each traction assembly of rope 6, common conduits 17, 18 are provided for each pair of cylinders 7, and common conduits 19, 20 are provided for each pair of cylinders 8. These conduits are rigid and extend along the I-section member 9; furthermore, they merge into flexible conduits or hoses designated diagrammatically at 21 in the jib structure of FIG. 1.

These conduits are controlled from the cab 2 constituting at the same time the engine room housing the hydraulic motors 22, pumps 23, solenoid-operated distributors 24, safety valves 25 and intercommunication distributors 26.

Each traction assembly further comprises a pair of endless tracks 27,28 mounted in parallel relationship at the top of said I-section members 9 and adapted to be pressed against the rope 6 by clamping cylinders 29 also controlled from the cab 2 and adapted to be actuated for causing the translation of the rope 6 at a fast rate; during this translation, the means comprising cylinders 30 controlling the traction blocks 13, 14 sets these blocks in their inoperative condition.

FIGS. 4A to 4D show the structure and operation of the endless tracks 27, 28 and clamping cylinders 29 on an enlarged scale. Referring to FIG. 4A, the cylinders 29 are illustrated as hydraulic cylinders which can press the endless tracks 27, 28 against the rope 6 in order to grip the rope and cause the translation of same at a rapid rate. However, in this Figure the cylinders are shown in an inoperative state and, accordingly, the tracks 27, 28 will not clamp the rope and the latter will not be driven thereby. In FIG. 4C, however, the cylinders 29 are shown in their actuated or operative state; that is the pistons have been actuated to cause clamping of the tracks against the rope to grip same and thereby cause the rapid translation of the rope 6.

With this device, a large number of combinations can be obtained for coupling the traction assemblies on each hoisting rope. FIGS. 7 to 11 illustrate diagrammatically various possible coupling combinations for the above-described assemblies A, B, C and D shown in FIG. 5.

Figure 6:
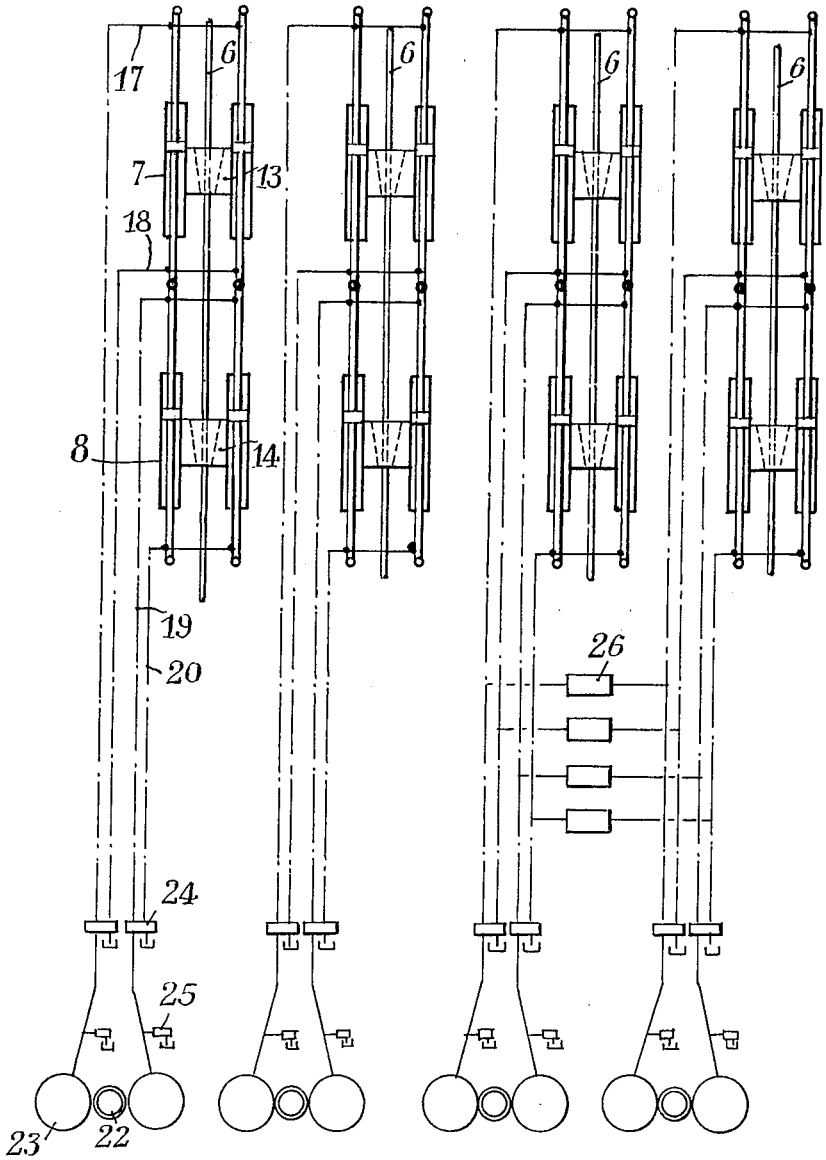
FIG. 6 is a diagrammatic view showing the function of these four traction assemblies.
Figure 7:
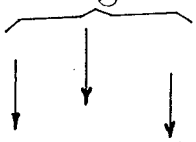
FIGS. 7 to 11 are diagrams similar to FIG. 5, showing various possible combinations of traction assemblies according to this invention.
Figure 8:
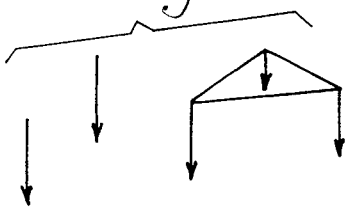
Figure 9:
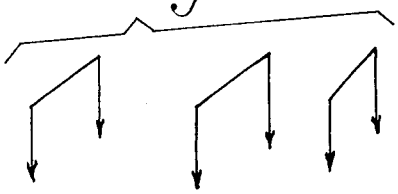
Figure 10:
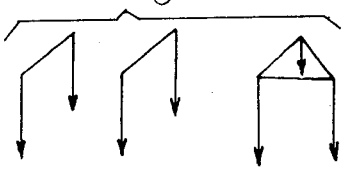
Figure 11:
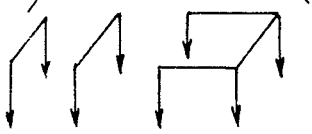
Figure 7A:
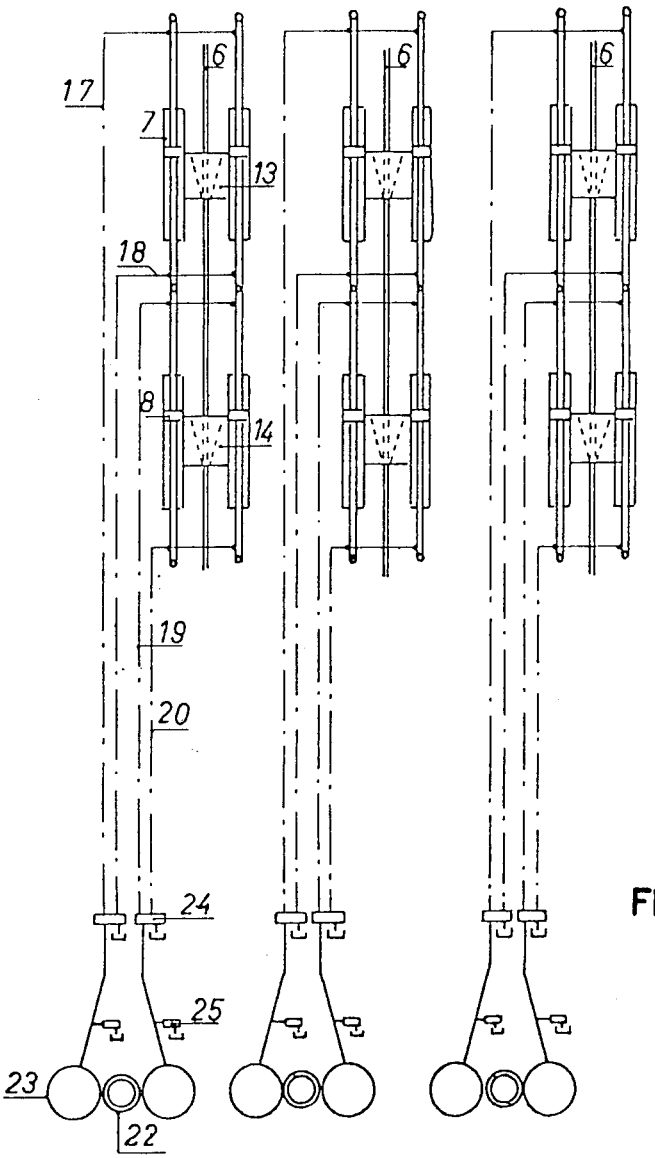
Figure 8A:
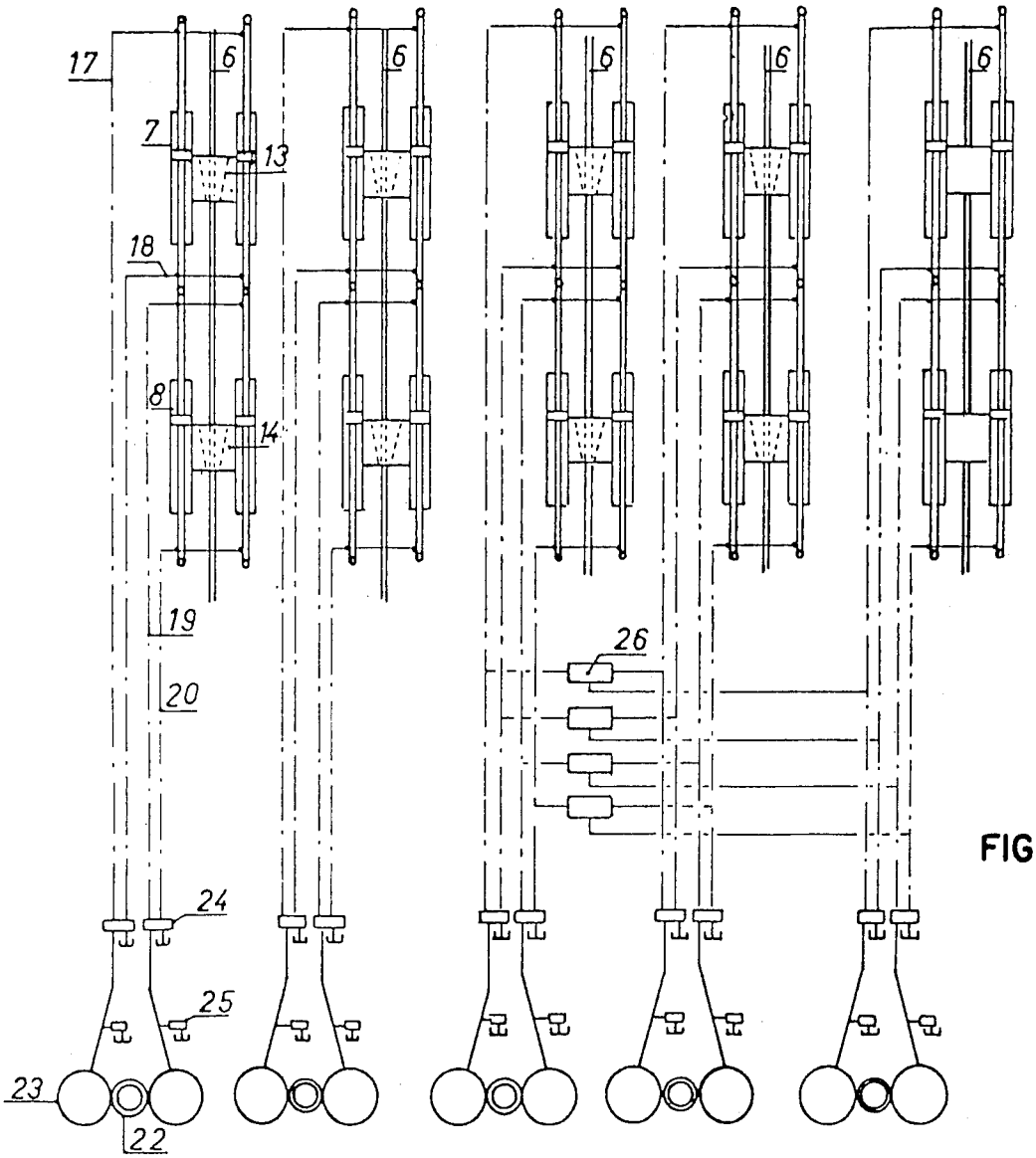
Figure 9A:
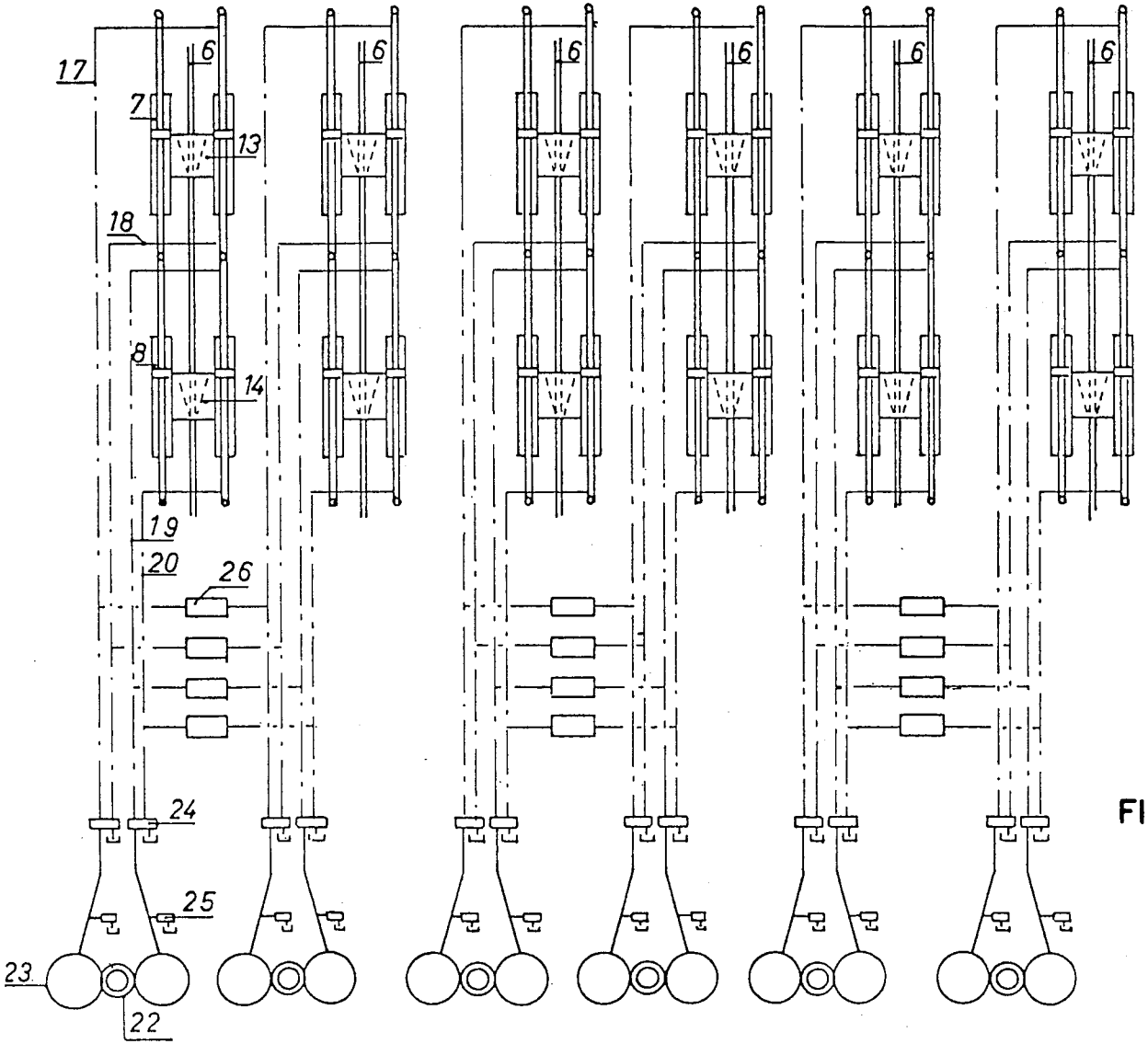
Figure 10A:
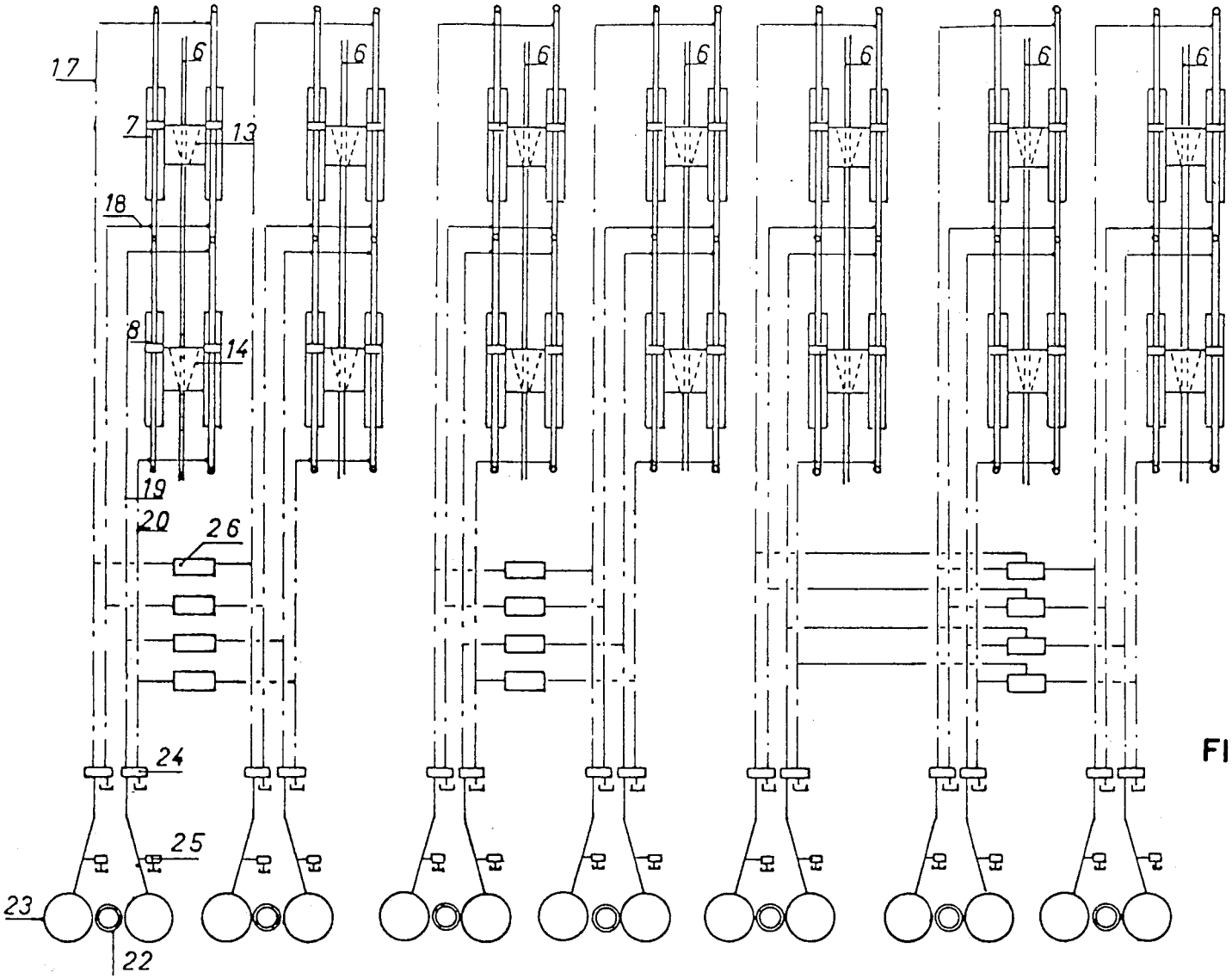
Figure 11A:
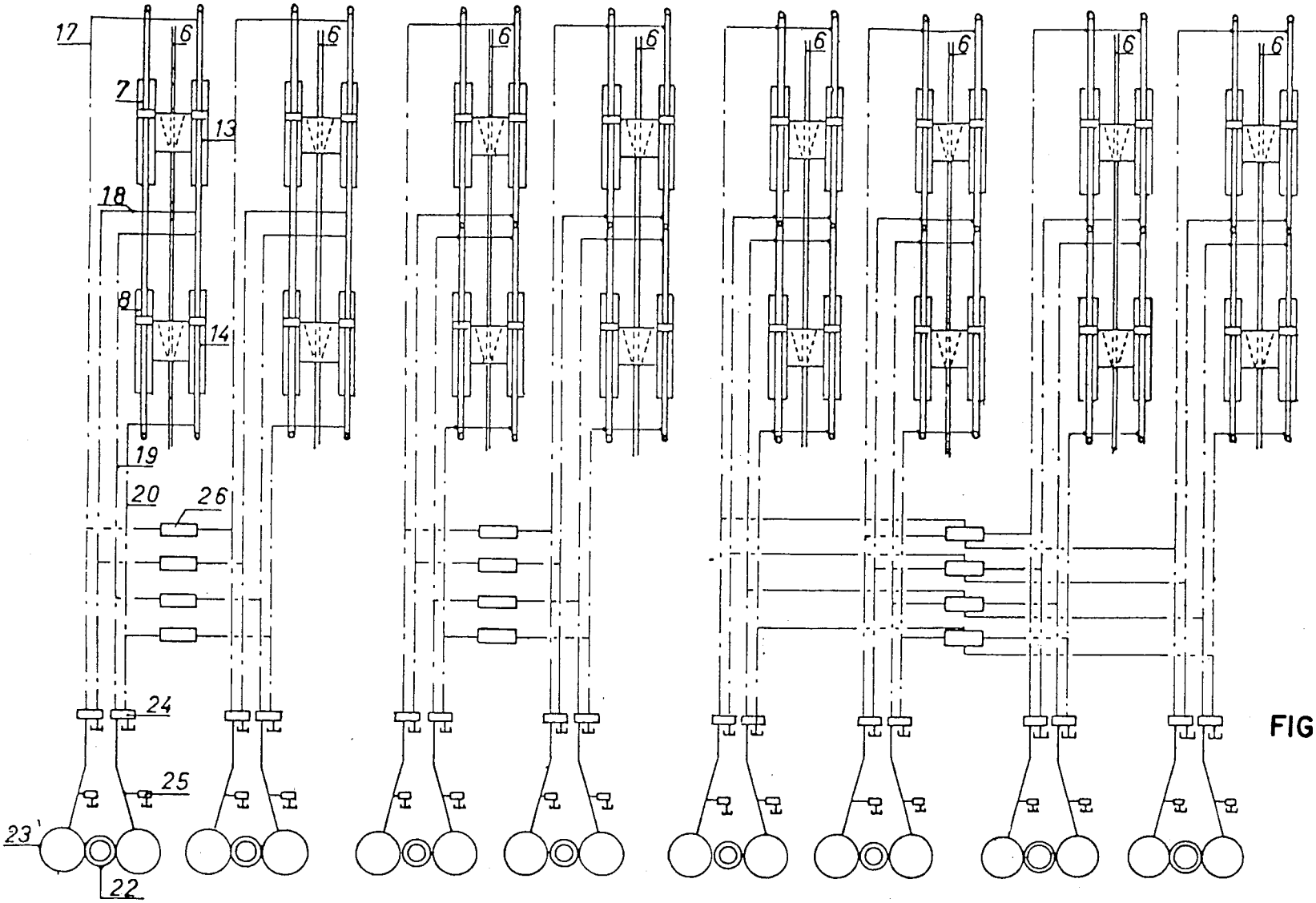

FIGS. 7A to 11A are diagrammatic views similar to FIG. 6 and show the function of the various possible combinations of traction assemblies shown in FIGS. 7 to 11, respectively. Thus, these FIGS. 7A to 11A show in more detail the conduit arrangement for the cylinders 7, 8, for the respective coupling combinations shown in FIGS. 7–11 and depict 3, 5, 6, 7 and 8 actuators corresponding to said FIGS. 7–11.

Of course, many modifications and changes may be brought to the load hoisting device described and illustrated herein by way of example, without departing however from the basic principles of the invention as set forth in the appended claims. Thus, such modifications and changes may be brought for instance to the shape of the frame structure supporting each assembly, to the cylinder position, the pivotal mounting of the crane jib, etc..

What we claim is:

1. A crane for hoisting and positioning a load in space, comprising a carrier base structure, a frame secured on said base structure, a control cab on said frame, a jib pivoted on said frame, a fish-plate assembly rigidly mounted at the outer end of said jib, at least three pull ropes for supporting the load, each rope having associated therewith a pair of parallel uprights suspended from said fish-plate assembly and two sets of rope traction members supported by each pair of uprights, each set of rope traction members comprising a pair of hydraulic traction cylinder and piston actuators and a jaw-type traction wedging block rigid with said pair of actuators with said rope passing therethrough, another cylinder and piston actuator for controlling the jaws of the traction block and being supported thereby, and means for controlling each one of said pair of hydraulic traction cylinder and piston actuators and each traction block control cylinder and piston actuator for pulling the rope step by step in each set of traction members.

2. A crane according to claim 1, wherein there is provided common hydraulic conduits for each pair of hydraulic traction cylinder and piston actuators and other conduits for each traction block cylinder and piston actuator, said conduits being supported by said uprights of each set of rope traction members, flexible guide means for said conduits disposed on said fish-plate assembly, flexible conduits for said guide means connected to said control means in said control cab, whereby the hydraulic traction cylinder and piston actuators and the traction block cylinder and piston actuators can be operated by turns.

3. A crane according to claim 1, wherein the control means for each set of rope traction members are so combined as to permit the coupling of two or more sets while the other sets remain independent.

4. A crane according to claim 1, wherein there is provided for each rope two endless tracks adapted to clamp the rope and move in parallel but in opposite directions, and cylinder and piston actuators for controlling said endless tracks which are operatively connected to the traction block cylinder and piston actuators for releasing the jaws of the blocks when said endless tracks are in operation.

5. A crane according to claim 1, wherein said uprights are suspended at their upper ends by a swivel cone mounted on a pivot device carried by said fish-plate assembly.

6. A crane according to claim 5, wherein each rope is provided with a curved guide member in the vicinity of said fish-plate assembly for bending the rope towards the jib.

* * * * *